US009768535B1

(12) United States Patent
Wu et al.

(10) Patent No.: US 9,768,535 B1
(45) Date of Patent: Sep. 19, 2017

(54) RECEPTACLE CONNECTOR WITH IMPROVED FASTENING AND CLAMPING COMPONENTS

(71) Applicant: Cheng Uei Precision Industry Co., Ltd., New Taipei (TW)

(72) Inventors: Yun Wu, Dong-Guan (CN); Chao-Yong Ye, Dong-Guan (CN); Kai-Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/209,726

(22) Filed: Jul. 13, 2016

(51) Int. Cl.

| | |
|---|---|
| ***H01R 12/00*** | (2006.01) |
| ***H01R 12/70*** | (2011.01) |
| ***H01R 13/648*** | (2006.01) |
| ***H01R 13/502*** | (2006.01) |
| ***H01R 24/60*** | (2011.01) |
| *H01R 107/00* | (2006.01) |

(52) U.S. Cl.
CPC ..... *H01R 12/707* (2013.01); *H01R 13/5025* (2013.01); *H01R 13/648* (2013.01); *H01R 24/60* (2013.01); *H01R 2107/00* (2013.01)

(58) Field of Classification Search
CPC ..... H01R 12/707
USPC ..... 439/82
See application file for complete search history.

(56) References Cited

U.S. PATENT DOCUMENTS

| | | | | |
|---|---|---|---|---|
| 5,718,605 | A * | 2/1998 | Morikawa | H01R 12/707 439/108 |
| 6,319,062 | B1 * | 11/2001 | Ma | H01R 24/64 439/490 |
| 6,962,510 | B1 * | 11/2005 | Chen | H01R 12/712 439/660 |
| 7,097,507 | B1 * | 8/2006 | Zhang | H01R 13/65802 439/607.35 |
| 7,481,667 | B2 * | 1/2009 | Cheng | H01R 13/7175 439/490 |
| 7,677,926 | B1 * | 3/2010 | Huang | H01R 13/65802 439/607.38 |
| 7,758,379 | B2 * | 7/2010 | Chen | H01R 13/6485 439/607.11 |
| 8,109,795 | B2 * | 2/2012 | Lin | H01R 13/6461 439/660 |
| 9,160,113 | B2 * | 10/2015 | Yu | H01R 24/64 |
| 9,263,811 | B2 * | 2/2016 | Hsu | H01R 12/58 |
| 9,391,398 | B2 * | 7/2016 | Omodachi | H01R 12/707 |

* cited by examiner

*Primary Examiner* — Tulsidas C Patel
*Assistant Examiner* — Peter G Leigh
(74) *Attorney, Agent, or Firm* — Cheng-Ju Chiang

(57) ABSTRACT

A receptacle connector includes an insulating housing, a plurality of terminals fastened to the insulating housing, a clamping element and two pairs of reinforcing blocks. A middle of a front surface of the insulating housing is recessed inward to form an insertion space. Two opposite sides of the insulating housing define two clamping grooves. The clamping element has a fixing board fastened to the insulating housing. Two opposite sides of the fixing board are bent frontward to form two clamping arms. Tail ends of the two clamping arms are connected with two clamping portions. The two pairs of reinforcing blocks are fastened in top walls and bottom walls of the two clamping grooves, respectively.

9 Claims, 9 Drawing Sheets

RECEPTACLE CONNECTOR WITH IMPROVED FASTENING AND CLAMPING COMPONENTS

BACKGROUND OF THE INVENTION

1. Field of the Invention

The present invention generally relates to a receptacle connector, and more particularly to a receptacle connector with a clamping function.

2. The Related Art

A conventional receptacle connector includes an insulating housing, a plurality of terminals, a clamping element and a shielding shell. The insulating housing defines an insertion space penetrating through a front surface of the insulating housing. Two side walls of the insertion space opens two clamping grooves penetrating through rear surfaces and inner surfaces of the two side walls of the insertion space. The two clamping grooves are communicated with the insertion space.

The terminals are fastened to the insulating housing and arranged transversely. Front ends of the terminals project into the insertion space. Rear ends of the terminals project out from the insulating housing and are soldered on a circuit board. The clamping element has a fastening plate, and two elastic clamping arms bent frontward from two opposite sides of the fastening plate. Tail ends of the two clamping arms are connected with two clamping portions, respectively. The fastening plate is fastened to the insulating housing. The two clamping arms are assembled to the two clamping grooves, respectively. The two clamping portions project into the insertion space through front ends of the two clamping grooves, respectively. The shielding shell surrounds the insulating housing.

However, in the process of a plug connector being inserted into or withdrawn from the insertion space of the receptacle connector, when the plug connector is shaken, plastics of the two side walls of the insertion space respectively adjacent to front ends of the two clamping grooves are easily squeezed down, in this way, a top wall and a bottom wall of each of the clamping grooves will clamp one of the clamping portions that makes the one of the clamping portions have no way of rebounding. As a result, a clamping function and a hand feeling of the receptacle connector are affected.

SUMMARY OF THE INVENTION

An object of the present invention is to provide a receptacle connector soldered to a circuit board. The receptacle connector includes an insulating housing, a plurality of terminals, a clamping element and two pairs of reinforcing blocks. A middle of a front surface of the insulating housing is recessed inward to form an insertion space. Two opposite sides of the insulating housing define two clamping grooves. Rear ends of the two clamping grooves penetrate through rear surfaces of the two opposite sides of the insulating housing, respectively. Front ends of the two clamping grooves penetrate through inner surfaces of two opposite side walls of the insertion space, respectively and are communicated with the insertion space. The terminals are fastened to the insulating housing and arranged transversely. Front ends of the terminals project into the insertion space. Rear ends of the terminals project out from the insulating housing and are soldered to the circuit board. The clamping element has a fixing board. Two opposite sides of the fixing board are bent frontward to form two clamping arms. Tail ends of the two clamping arms are connected with two clamping portions. The fixing board is fastened to the insulating housing. The two clamping arms are assembled in the two clamping grooves, respectively. The two clamping portions project into the insertion space through the two clamping grooves, respectively. The two pairs of reinforcing blocks are fastened in top walls and bottom walls of the two clamping grooves, respectively.

As described above, the two pairs of reinforcing blocks are fastened in the top walls and the bottom walls of the two clamping grooves, respectively, so when a plug connector is inserted into or withdrawn from the receptacle connector, plastics of the two side walls of the insertion space respectively adjacent to the front ends of the two clamping grooves squeezed down by the plug connector are just limited to be the plastics located between the reinforcing blocks and the plug connector, so an amount of the plastics squeezed down by the plug connector is decreased to the greatest extent, in this way, the front ends of the top wall and the bottom wall of each of the two clamping grooves will be without clamping one of the clamping portions, so the clamping portions are capable of rebounding freely. So that a clamping function and a hand feeling of the receptacle connector are affected.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
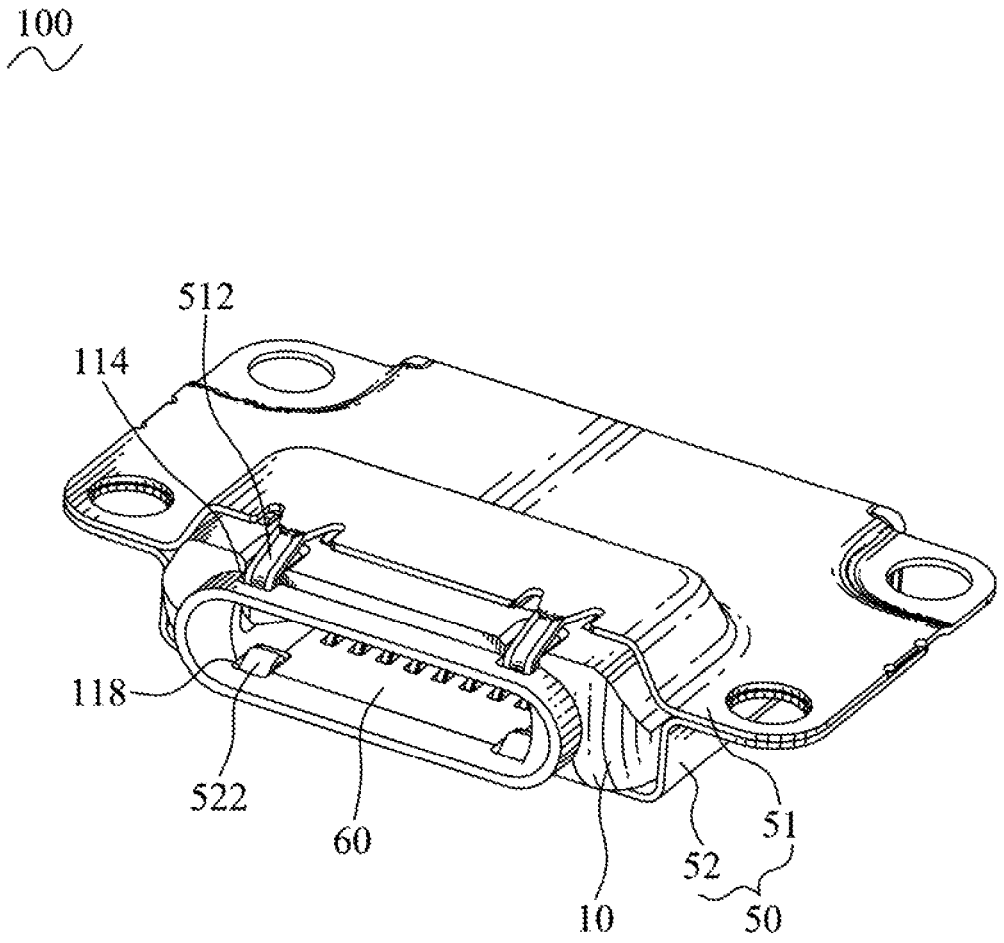
FIG. 1 is a perspective view of a receptacle connector in accordance with a preferred embodiment of the present invention.
Figure 2:
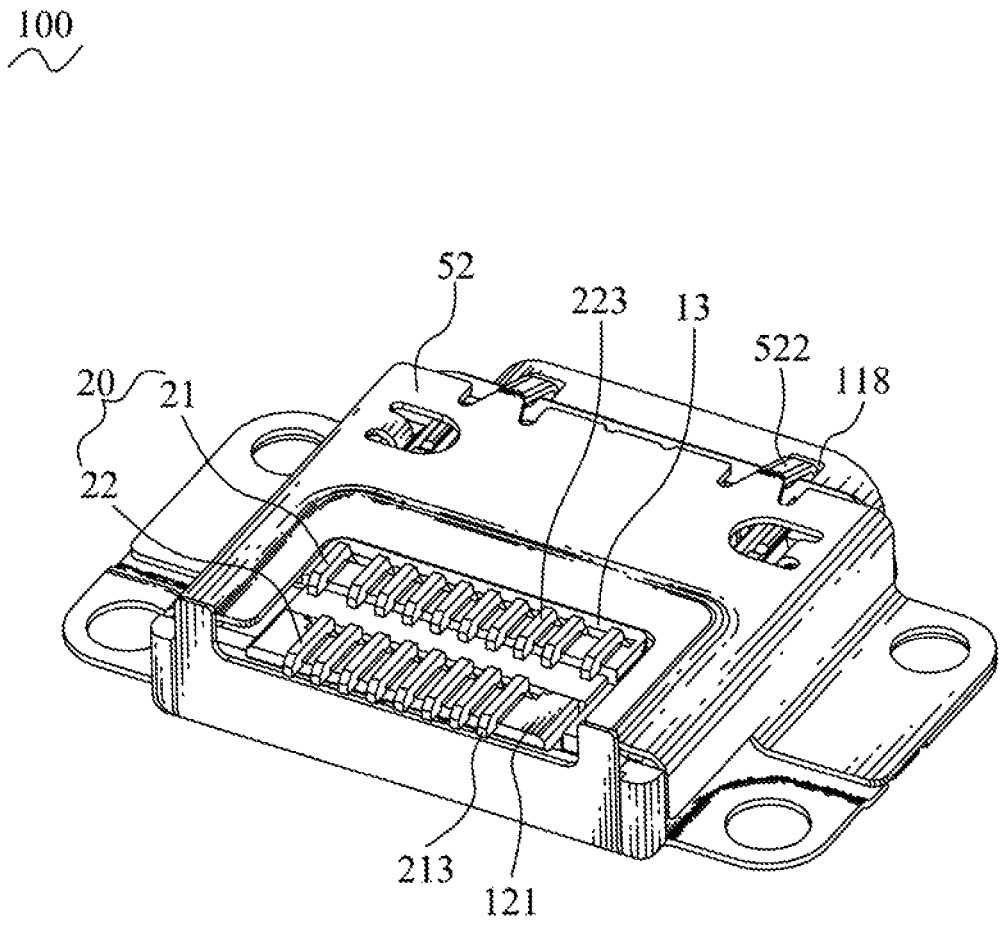
FIG. 2 is another perspective view of the receptacle connector of FIG. 1.
Figure 3:
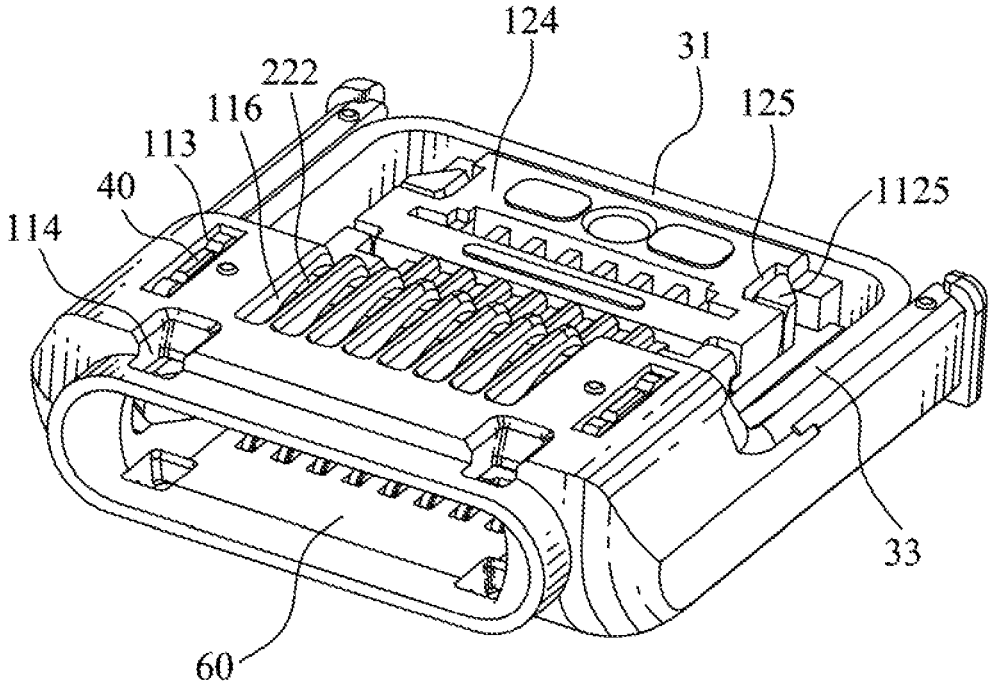
FIG. 3 is a perspective view of the receptacle connector of FIG. 1, wherein a shielding shell is omitted.

With reference to FIG. 1, FIG. 2, FIG. 3 and FIG. 5, a receptacle connector 100 in accordance with a preferred embodiment of the present invention is shown. The receptacle connector 100 is soldered to a circuit board (not shown). The receptacle connector 100 adapted for docking with a plug connector (not shown), includes an insulating housing 10, a plurality of terminals 20, a clamping element 30, two pairs of reinforcing blocks 40 and a shielding shell 50.

Figure 4:
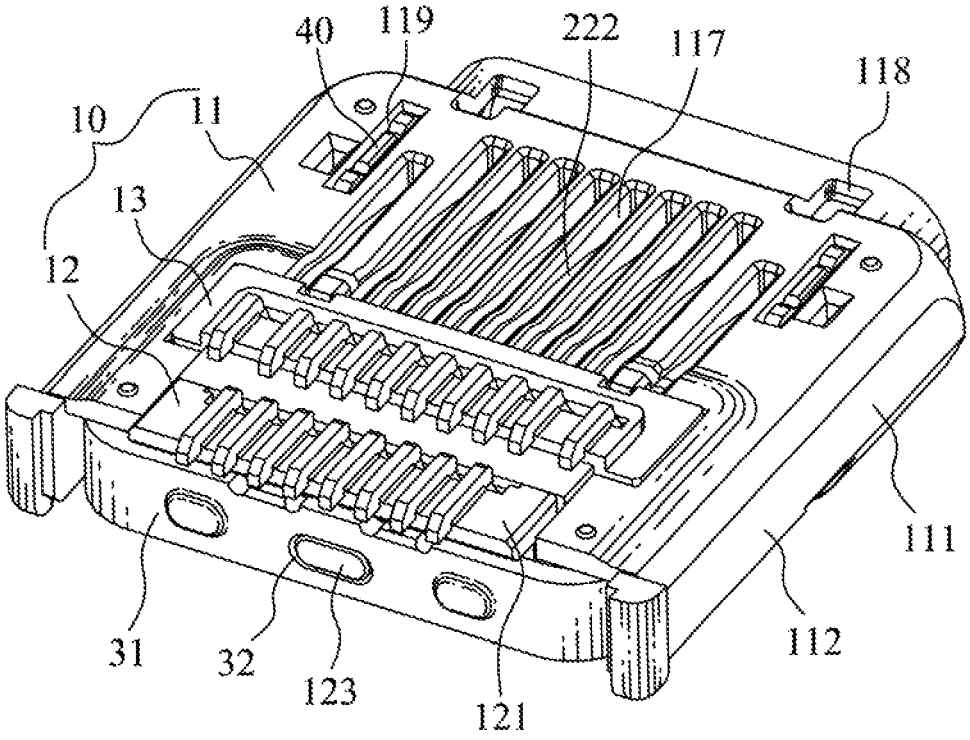
FIG. 4 is another perspective view of the receptacle connector of FIG. 1, wherein the shielding shell is omitted.
Figure 5:
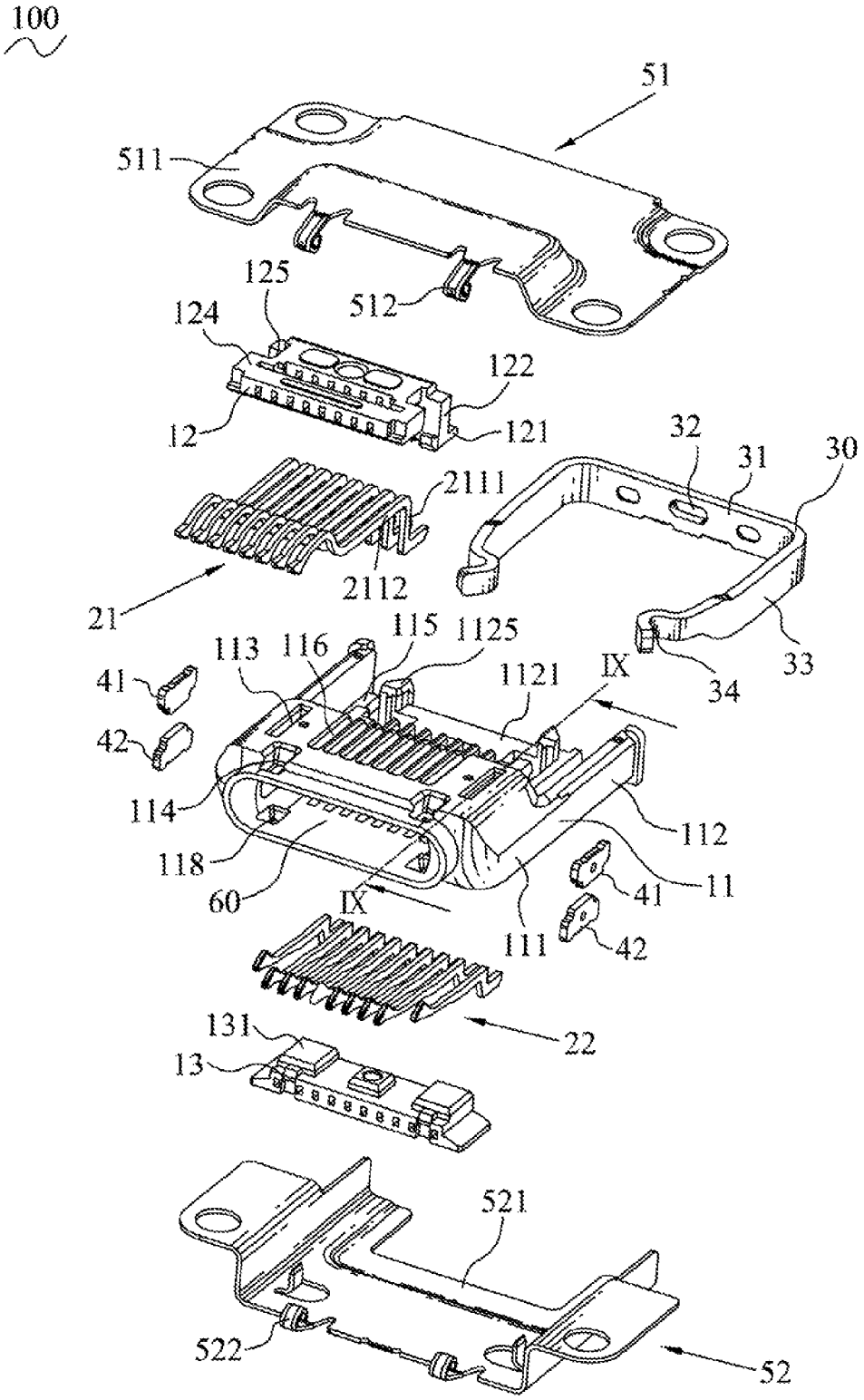
FIG. 5 is an exploded view of the receptacle connector of FIG. 1.

Referring to FIG. 4 and FIG. 5, the insulating housing 10 includes a main body 11, an upper fastening block 12 and a lower fastening block 13. The main body 11 has a rectangular base portion 111, and an extending portion 112 extended rearward from a lower portion of a rear surface of the base portion 111.

Referring to FIG. 4, FIG. 5, FIG. 6 and FIG. 9, a middle of a front surface of the insulating housing 10 is recessed inward to form an insertion space 60. Two opposite sides of the insulating housing 10 define two clamping grooves 115. Rear ends of the two clamping grooves 115 penetrate through rear surfaces of the two opposite sides of the insulating housing 10, respectively. Front ends of the two clamping grooves 115 penetrate through inner surfaces of two opposite side walls of the insertion space 60, respectively. So the front ends of the two clamping grooves 115 are communicated with the insertion space 60.

Two opposite sides of a top of the insulating housing 10 open a pair of first fastening holes 113 communicated with the two clamping grooves 115, respectively. Two opposite sides of a bottom of the insulating housing 10 open a pair of second fastening holes 119 communicated with the two clamping grooves 115, respectively. The top of the insulating housing 10 defines at least one first perforation 114 located in front of an area between the two first fastening holes 113. The bottom of the insulating housing 10 defines at least one second perforation 118 located in front of an area between the two second fastening holes 119. The first perforation 114 and the second perforation 118 are communicated with the insertion space 60.

Specifically, a front surface of the base portion 111 is recessed inward to form the insertion space 60. Two opposite sides of a top of the base portion 111 open the pair of first fastening holes 113 respectively extending to tops of the two clamping grooves 115. Two opposite sides of a bottom of the base portion 111 open the pair of second fastening holes 119 respectively extending to bottoms of the two clamping grooves 115. The top of the base portion 111 defines the two first perforations 114 located in front of an area between the two first fastening holes 113. The bottom of the base portion 111 defines the two second perforations 118 located in front of an area between the two second fastening holes 119.

The two clamping grooves 115 longitudinally penetrate through two opposite sides of an upper portion of a rear surface of the extending portion 112, respectively, and the two clamping grooves 115 transversely extend to and are communicated with two opposite sides of the insertion space 60, respectively. A rear end of a top surface of the extending portion 112 is recessed downward to form a lacking groove 1121. A bottom wall of the lacking groove 1121 defines a gap 1122 penetrating through a top surface, a rear surface and a bottom surface thereof. A rear end of a bottom surface of the extending portion 112 is recessed inward to form an assembling groove 1123. The bottom wall of the lacking groove 1121 defines a plurality of assembling holes 1124 located above and communicated with the assembling groove 1123. Two opposite sides of a middle of the bottom wall of the lacking groove 1121 protrude upward to form two blocking portions 1125.

The top of the insulating housing 10 defines a plurality of upper terminal grooves 116 arranged transversely. The bottom of the insulating housing 10 defines a plurality of lower terminal grooves 117 arranged transversely. Specifically, the upper terminal grooves 116 penetrate through a rear surface and a rear end of a top surface of the base portion 111, and a front end of the top surface of the extending portion 112. The upper terminal grooves 116 extend to the lacking groove 1121. The lower terminal grooves 117 penetrate through a rear end of a bottom surface of the base portion 111 and a front end of the bottom surface of the extending portion 112. The lower terminal grooves 117 extend to the assembling groove 1123. Front ends of the upper terminal grooves 116 penetrate through a top wall of the insertion space 60 and are communicated with the insertion space 60. Front ends of the lower terminal grooves 117 penetrate through a bottom wall of the insertion space 60 and are communicated with the insertion space 60.

The upper fastening block 12 has an upper base board 121, a locating board 122 protruded upward from a front end of a top surface of the upper base board 121. A middle of a rear surface of the locating board 122 protrudes rearward to form a fastening pillar 123. An upper end of a front surface of the locating board 122 protrudes frontward to form an extending board 124. Two portions of two side surfaces of the extending board 124 are recessed inward to form two limiting grooves 125. Several portions of a top surface of the lower fastening block 13 protrude upward to form a plurality of protruding blocks 131 arranged transversely.

Figure 6:
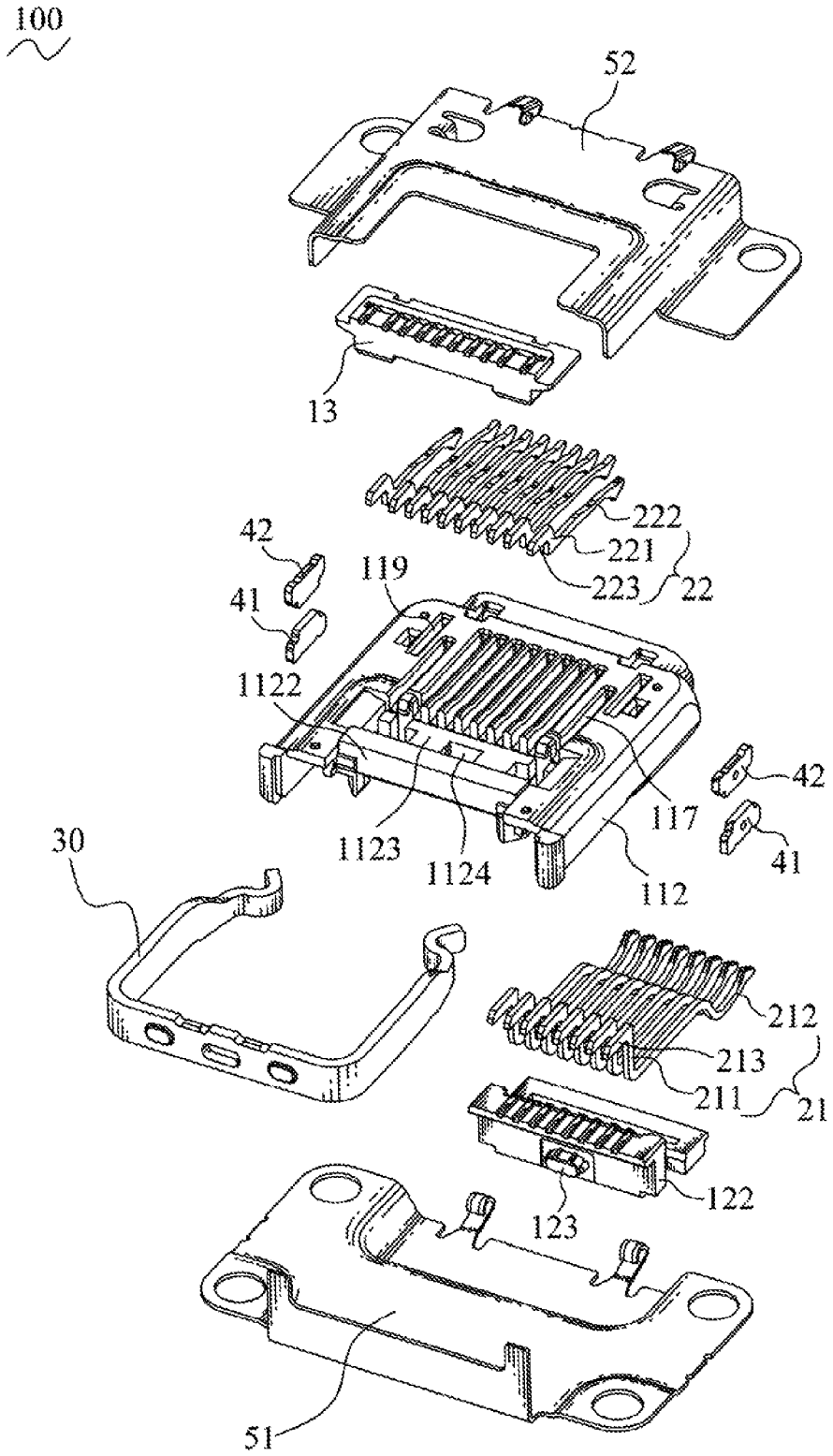
FIG. 6 is another exploded view of the receptacle connector of FIG. 5.
Figure 7:
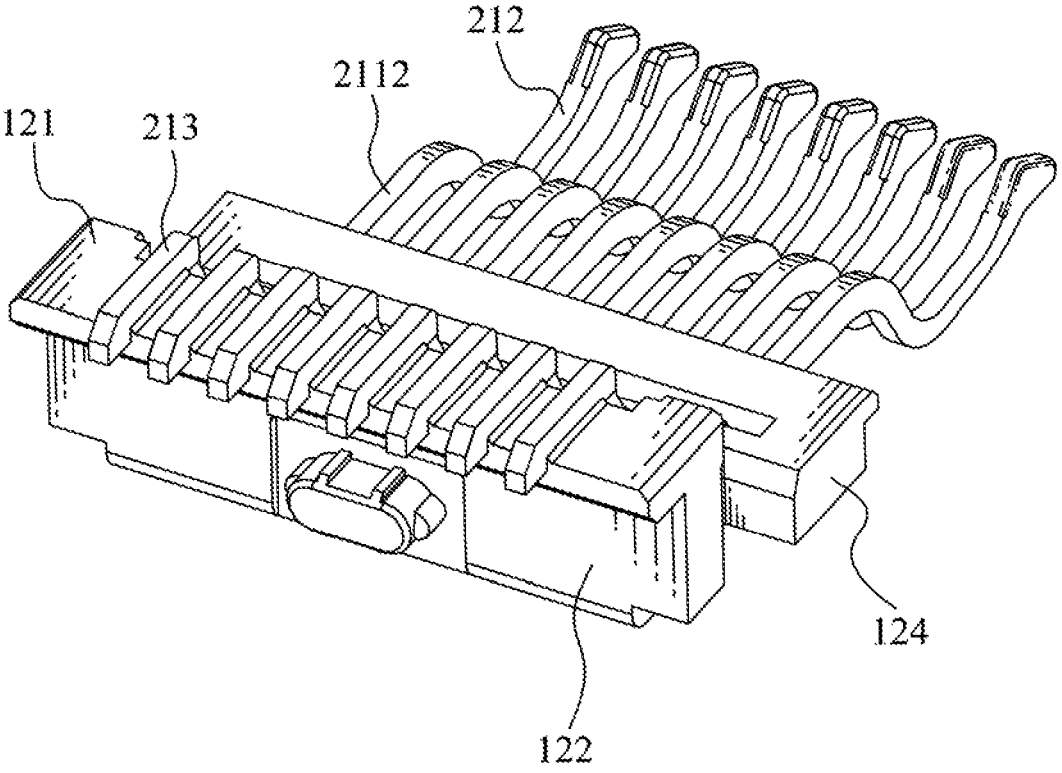
FIG. 7 is a partially perspective view of the receptacle connector of FIG. 5, wherein upper terminals are fastened to an upper fastening block.
Figure 8:
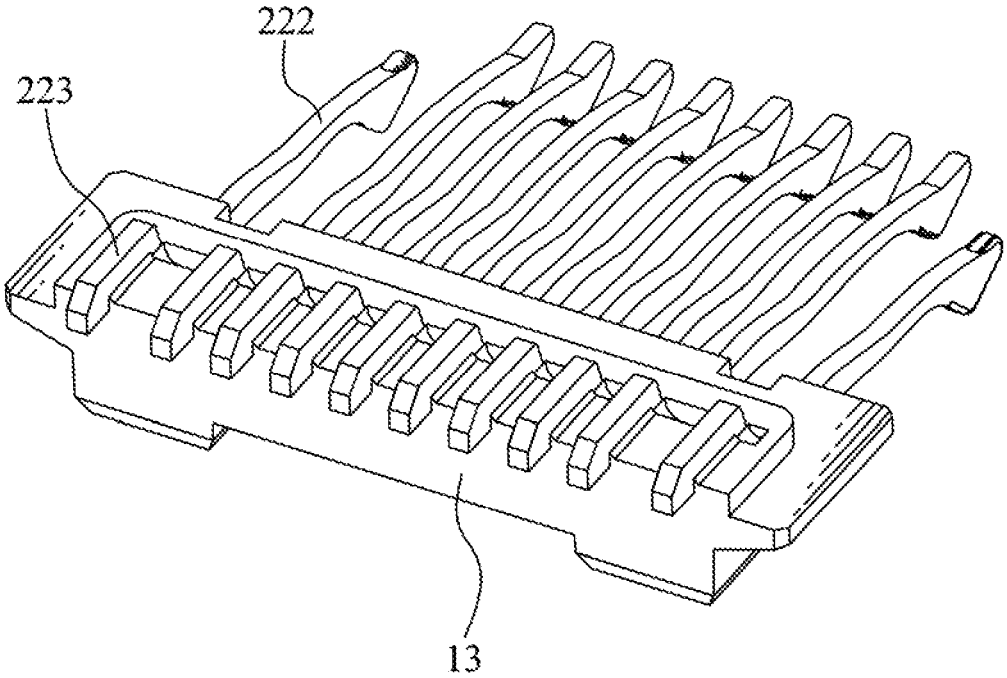
FIG. 8 is a partially perspective view of the receptacle connector of FIG. 5, wherein lower terminals are fastened to a lower fastening block.
Figure 9:
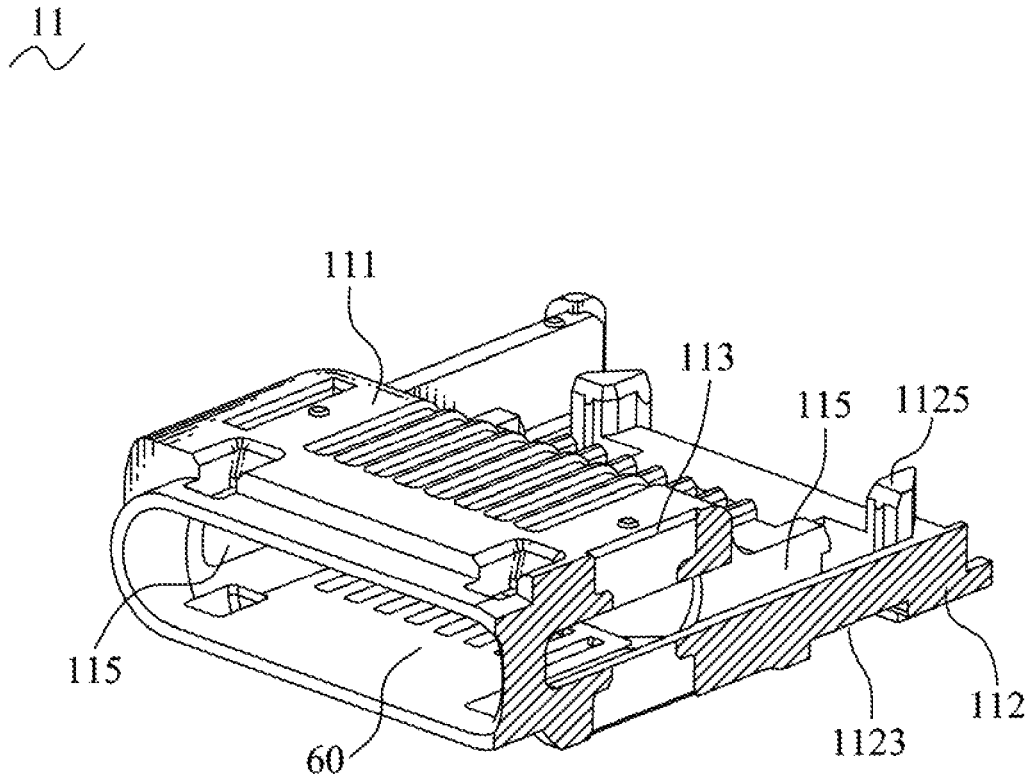
FIG. 9 is a sectional view of a main body of the receptacle connector along a line IX-IX of FIG. 5.

Referring to FIG. 5, FIG. 6 and FIG. 7, the terminals 20 include a plurality of upper terminals 21 and a plurality of lower terminals 22. Each of the upper terminals 21 has an upper fastening portion 211. The upper fastening portion 211 has a first fastening strip 2111 extending up and down, and a second fastening strip 2112 bent frontward from a top end of the first fastening strip 2111. A front end of the second fastening strip 2112 is bent upward and frontward, and then bent frontward and downward and further arched downward to form an upper contact portion 212. A bottom end of the first fastening strip 2111 is bent rearward to form an upper soldering portion 213.

Each of the lower terminals 22 has a lower fastening portion 221 extending upward and downward, a lower contact portion 222 extended frontward from an upper end of the lower fastening portion 221, and a lower soldering portion 223 extended rearward from a lower end of the lower fastening portion 221.

Referring to FIG. 5, the clamping element 30 is of a U shape. The clamping element 30 has a fixing board 31 extending transversely. A middle of the fixing board 31 defines a fixing hole 32. Two opposite sides of the fixing board 31 are bent frontward to form two clamping arms 33. Tail ends of the two clamping arms 33 are connected with two clamping portions 34. The tail ends of the two clamping arms 33 are arched inward to form the two clamping portions 34.

Referring to FIG. 4, FIG. 5 and FIG. 6, the two pairs of reinforcing blocks 40 include a pair of first reinforcing blocks 41 and a pair of second reinforcing blocks 42. The two pairs of reinforcing blocks 40 are made of metal material. The two pairs of reinforcing blocks 40 are T-shaped boards.

Referring to FIG. 1 and FIG. 5, the shielding shell 50 includes an upper shell 51 and a lower shell 52. The upper shell 51 has an upper base plate 511. A front end of the upper base plate 511 is connected with at least one upper abutting portion 512. The lower shell 52 has a lower base plate 521. A front end of the lower base plate 521 is connected with at least one lower abutting portion 522. Specifically, the front end of the upper base plate 511 is connected with two upper abutting portions 512 arranged transversely. The front end of the lower base plate 521 is connected with two lower abutting portions 522 arranged transversely.

Referring to FIG. 1 to FIG. 9, when the receptacle connector 100 is assembled, the terminals 20 are fastened to the insulating housing 10 and arranged transversely. Front ends of the terminals 20 project into the insertion space 60. Rear ends of the terminals 20 project out from the insulating housing 10 and are soldered to the circuit board. The lower terminals 22 are fastened to the lower terminal grooves 117 and arranged transversely. Front ends of the lower terminals 22 project into the insertion space 60 from the front ends of the lower terminal grooves 117. Rear ends of the lower terminals 22 project out from the insulating housing 10 and are soldered to the circuit board. Specifically, the lower terminals 22 are integrally molded to the lower fastening block 13 and arranged transversely. The lower fastening portion 221, a rear end of the lower contact portion 222 and a top of the lower soldering portion 223 are integrally molded in the lower fastening block 13. A bottom of the lower soldering portion 223 is exposed out of a bottom surface of the lower fastening block 13.

The lower fastening block 13 is assembled to the assembling groove 1123. The protruding blocks 131 are assembled in the assembling holes 1124. Bottom surfaces of the protruding blocks 131 are exposed to the bottom surface of the extending portion 112. A front end of the lower contact portion 222 of each of the lower terminals 22 is disposed in one of the lower terminal grooves 117. The front end of the lower contact portion 222 of each of the lower terminals 22 projects into the insertion space 60 through a front end of the one of the lower terminal grooves 117. A bottom surface of the lower soldering portion 223 projects beyond the bottom surface of the extending portion 112 and is soldered to the circuit board.

The upper terminals 21 are fastened to the upper terminal grooves 116 and arranged transversely. Front ends of the upper terminals 21 project into the insertion space 60 from the front ends of the upper terminal grooves 116. Rear ends of the upper terminals 21 project out from the insulating housing 10 and are soldered to the circuit board. Specifically, the upper terminals 21 are integrally molded to the upper fastening block 12 and arranged transversely. The first fastening strip 2111 is integrally molded in the locating board 122. A rear end of the second fastening strip 2112 is integrally molded in the extending board 124. A top of the upper soldering portion 213 is molded in the upper base board 121. A bottom of the upper soldering portion 213 is exposed out of a bottom surface of the upper base board 121.

The extending board 124 is assembled in the lacking groove 1121. The two blocking portions 1125 are limited in the two limiting grooves 125, respectively. The locating board 122 is located in the gap 1122. The bottom surface of the upper base board 121 projects beyond the bottom surface of the extending portion 112 and is flush with the bottom surface of the lower fastening block 13. The upper soldering portion 213 is soldered to the circuit board. The front end of the second fastening strip 2112 and the upper contact portion 212 are disposed in one of the upper terminal grooves 116. A front end of the upper contact portion 212 projects into the insertion space 60 through a front end of the one of the upper terminal grooves 116.

The clamping element 30 is fastened to a rear end of the insulating housing 10. Specifically, the fixing board 31 is fastened to the insulating housing 10. The fixing board 31 is fixed to a rear surface of the locating board 122. The fastening pillar 123 is fastened in the fixing hole 32. The two clamping arms 33 are assembled in the two clamping grooves 115, respectively. The two clamping portions 34 are assembled in front ends of the two clamping grooves 115, respectively. The two clamping portions 34 project into the insertion space 60 through the two clamping grooves 115, respectively.

The two pairs of reinforcing blocks 40 are fastened in the two opposite sides of the top of the insulating housing 10 and the two opposite sides of the bottom of the insulating housing 10, respectively. The two pairs of reinforcing blocks 40 are fastened in top walls and bottom walls of the two clamping grooves 115, respectively. The pair of first reinforcing blocks 41 are fastened in the two opposite sides of the top of the insulating housing 10 and are located in the top walls of the two clamping grooves 115. The pair of second reinforcing blocks 42 are fastened in the two opposite sides of the bottom of the insulating housing 10 and are located in the bottom walls of the two clamping grooves 115. The pair of first reinforcing blocks 41 are fastened in the two first fastening holes 113, respectively. The pair of second reinforcing blocks 42 are fastened in the two second fastening holes 119, respectively. Each of the first reinforcing blocks 41 faces to one of the second reinforcing blocks 42.

The shielding shell 50 surrounds the insulating housing 10. Specifically, the lower shell 52 is fastened to a bottom of the insulating housing 10. The upper shell 51 is fastened to a top of the insulating housing 10. The upper shell 51 is matched with and fastened together with the lower shell 52. The upper abutting portion 512 projects into the insertion space 60 through the first perforation 114. The lower abutting portion 522 projects into the insertion space 60 through the second perforation 118.

When a plug connector (not shown) is inserted into or withdrawn from the receptacle connector 100, plastics of the two side walls of the insertion space 60 respectively adjacent to the front ends of the two clamping grooves 115 squeezed down by the plug connector are just limited to be plastics located between the reinforcing blocks 40 and the plug connector, so an amount of the plastics squeezed down by the plug connector is decreased to the greatest extent. Front ends of the top wall and the bottom wall of each of the two clamping grooves 115 will be without clamping one of the clamping portions 34, so the clamping portions 34 are capable of rebounding freely, so that a clamping function and a hand feeling of the receptacle connector 100 are affected.

As described above, the two pairs of reinforcing blocks 40 are fastened in the top walls and the bottom walls of the two clamping grooves 115, respectively, so when the plug connector is inserted into or withdrawn from the receptacle connector 100, the plastics of the two side walls of the insertion space 60 respectively adjacent to the front ends of the two clamping grooves 115 squeezed down by the plug connector are just limited to be the plastics located between the reinforcing blocks 40 and the plug connector, so the amount of the plastics squeezed down by the plug connector is decreased to the greatest extent, in this way, the front ends of the top wall and the bottom wall of each of the two clamping grooves 115 will be without clamping one of the clamping portions 34, so the clamping portions 34 are capable of rebounding freely. So that the clamping function and the hand feeling of the receptacle connector 100 are affected.

What is claimed is:

1. A receptacle connector with improved fastening and clamping components, soldered to a circuit board, comprising:

an insulating housing, a middle of a front surface of the insulating housing being recessed inward to form an insertion space, two opposite sides of the insulating housing defining two clamping grooves, rear ends of the two clamping grooves penetrating through rear surfaces of the two opposite sides of the insulating housing, respectively, front ends of the two clamping grooves penetrating through inner surfaces of two opposite side walls of the insertion space, respectively and being communicated with the insertion space;

a plurality of terminals fastened to the insulating housing and arranged transversely, front ends of the terminals projecting into the insertion space, rear ends of the terminals projecting out from the insulating housing and being soldered to the circuit board;

a clamping element having a fixing board, two opposite sides of the fixing board bent frontward to form two clamping arms, tail ends of the two clamping arms being connected with two clamping portions, the fixing board being fastened to the insulating housing, the two clamping arms being assembled in the two clamping grooves, respectively, the two clamping portions projecting into the insertion space through the two clamping grooves, respectively;

two pairs of reinforcing blocks fastened in top walls and bottom walls of the two clamping grooves, respectively; and a shielding shell including an upper shell and a lower shell, the lower shell being fastened to a bottom of the insulating housing, the upper shell being fastened to a top of the insulating housing, the upper shell being matched with and fastened together with the lower shell;

wherein the top of the insulating housing defines at least one first perforation, the bottom of the insulating housing defines at least one second perforation, the upper shell has an upper base plate, a front end of the upper base plate is connected with at least one upper abutting portion, the lower shell has a lower base plate, a front end of the lower base plate is connected with at least one lower abutting portion, the upper abutting portion projects into the insertion space through the first perforation, the lower abutting portion projects into the insertion space through the second perforation.

2. The receptacle connector with improved fastening and clamping components as claimed in claim 1, wherein two opposite sides of a top of the insulating housing open a pair of first fastening holes communicated with the two clamping grooves, respectively, two opposite sides of a bottom of the insulating housing open a pair of second fastening holes communicated with the two clamping grooves, respectively, the two pairs of reinforcing blocks including a pair of first reinforcing blocks and a pair of second reinforcing blocks, the pair of first reinforcing blocks are fastened in the two first fastening holes, respectively, the pair of second reinforcing blocks are fastened in the two second fastening holes, respectively.

3. The receptacle connector with improved fastening and clamping components as claimed in claim 2, wherein each of the first reinforcing blocks faces to one of the second reinforcing blocks.

4. The receptacle connector with improved fastening and clamping components as claimed in claim 2, wherein the insulating housing includes a main body which has a base portion, a front surface of the base portion is recessed inward to form the insertion space, two opposite sides of a top of the base portion open the pair of first fastening holes respectively extending to tops of the two clamping grooves, two opposite sides of a bottom of the base portion open the pair of second fastening holes respectively extending to bottoms of the two clamping grooves.

5. The receptacle connector with improved fastening and clamping components as claimed in claim 4, wherein the main body has an extending portion extended rearward from a lower portion of a rear surface of the base portion, the two clamping grooves longitudinally penetrate through two opposite sides of an upper portion of a rear surface of the extending portion, respectively, and the two clamping grooves transversely extend to and are communicated with two opposite sides of the insertion space, respectively.

6. The receptacle connector with improved fastening and clamping components as claimed in claim 1, wherein the terminals include a plurality of lower terminals, a bottom of the insulating housing defines a plurality of lower terminal grooves arranged transversely, front ends of the lower terminal grooves penetrate through a bottom wall of the insertion space and are communicated with the insertion space, the lower terminals are fastened to the lower terminal grooves and arranged transversely, front ends of the lower terminals project into the insertion space from the front ends of the lower terminal grooves, rear ends of the lower terminals project out from the insulating housing and are soldered to the circuit board.

7. The receptacle connector with improved fastening and clamping components as claimed in claim 1, wherein the terminals include a plurality of upper terminals, a top of the insulating housing defines a plurality of upper terminal grooves arranged transversely, front ends of the upper terminal grooves penetrate through a top wall of the insertion space and are communicated with the insertion space, the upper terminals are fastened to the upper terminal grooves and arranged transversely, front ends of the upper terminals project into the insertion space from the front ends of the upper terminal grooves, rear ends of the upper terminals project out from the insulating housing and are soldered to the circuit board.

8. The receptacle connector with improved fastening and clamping components as claimed in claim 1, wherein the two pairs of reinforcing blocks are made of metal material.

9. The receptacle connector with improved fastening and clamping components as claimed in claim 1, wherein the two pairs of reinforcing blocks are T-shaped boards.

* * * * *